US006842986B2

(12) United States Patent
Holler

(10) Patent No.: US 6,842,986 B2
(45) Date of Patent: Jan. 18, 2005

(54) CUTTING TOOL WITH SLOPING PROXIMAL PORTION AND ASSOCIATED METHODS

(76) Inventor: Christopher A. Holler, 2449 Via Sienna Ave., Winter Park, FL (US) 32789

( * ) Notice: Subject to any disclaimer, the term of this patent is extended or adjusted under 35 U.S.C. 154(b) by 17 days.

(21) Appl. No.: 10/298,258

(22) Filed: Nov. 15, 2002

(65) Prior Publication Data

US 2004/0093741 A1 May 20, 2004

(51) Int. Cl.[7] ..... B26B 3/00
(52) U.S. Cl. ..... 30/314; 30/346; 30/353
(58) Field of Search ..... 30/314, 315, 317, 30/346, 340, 342, 294, 353, 280, 286, 142, 308, 356; D22/118; D7/469, 650

(56) References Cited

U.S. PATENT DOCUMENTS

| | | | | | |
|---|---|---|---|---|---|
| 31,534 | A | * | 2/1861 | McKinzie | 177/252 |
| 49,164 | A | * | 8/1865 | Strachan | 56/394 |
| 116,027 | A | * | 6/1871 | Coulon | D7/649 |
| 502,042 | A | * | 7/1893 | Jenner | 30/314 |
| 912,146 | A | * | 2/1909 | Moffett | 30/353 |
| 914,947 | A | * | 3/1909 | Hammerly | 30/318 |
| 979,686 | A | * | 12/1910 | Nelson et al. | 30/142 |
| 1,239,065 | A | * | 9/1917 | Wigiert | 42/53 |
| 1,398,850 | A | * | 11/1921 | Franco | 7/114 |
| 1,552,153 | A | * | 9/1925 | Hartbauer | 30/287 |
| 1,614,772 | A | * | 1/1927 | Bambini et al. | 30/286 |
| 1,645,101 | A | * | 10/1927 | Gibb et al. | 81/15.2 |
| 1,679,806 | A | * | 8/1928 | Bockstadter | 172/381 |
| 1,698,111 | A | * | 1/1929 | Clark | 30/353 |
| 2,007,700 | A | * | 7/1935 | Ziminski | 30/314 |
| 2,048,322 | A | * | 7/1936 | Cathey | 30/346 |
| 2,279,833 | A | * | 4/1942 | Madan | 30/353 |
| 2,429,405 | A | * | 10/1947 | Dringman | 30/142 |

(List continued on next page.)

OTHER PUBLICATIONS

Kitchenetc (http://www.kitchenetc.com/Products.cfm?sku=000916411), Deli Knife 8", Apr. 8, 2002, 8 pages.*

Titan Hunting Knife available at www.knifecollection.com/titan.html.

KnifeCenter, Inc., 1995–2003, Ka–bar USMC Fighting Knife with Black Blade and Handle available at www.knifecenter.com/knifecenter/kbar/usmc3.html.

Badger Information Service, Fighting Hunting Knife available at www.knifecollection.com/nhunt.html.

A.G. Russell Knives, 2002, Ka–bar D2 Combat Knife, available at www.4knives.net/ka–bar/ka1281.html.

Bundeswehr Advanced Combat Knife, available at web2.cnnb.net/game/cs/weapon/knife.htm.

Various knives available at www.zvis.com/knives/knimgtm-pl.shtml?/images/knives/custom.

Knife Outlet, various knives, available at www.knifeoutlet-.com/shop/10Browse.asp?Search=headliner.

Blades2000.com, 2000–2002, various knives, available at www.blades2000.com.

*Primary Examiner*—Allan N. Shoap
*Assistant Examiner*—Ghassem Alie
(74) *Attorney, Agent, or Firm*—The Torpy Group

(57) ABSTRACT

A cutting tool includes an elongate handle to be grasped by a user, and an elongate blade connected to the elongate handle. The elongate blade includes a downwardly sloping proximal portion extending outwardly from an end of the handle, and a linear distal portion extending substantially parallel to and downwardly offset from an axis defined by the elongate handle and ending in a tapered tip. The downwardly sloping proximal portion may have a sharpened lower edge, and the linear offset distal portion may have a sharpened lower edge. In some embodiments, the elongate blade may have a length of less than about twelve inches so that the cutting tool is a knife, and in other embodiments, the elongate blade may have a length of greater than about twelve inches so that the cutting tool is a sword.

28 Claims, 2 Drawing Sheets

U.S. PATENT DOCUMENTS

| | | | | | |
|---|---|---|---|---|---|
| 2,635,337 | A | * | 4/1953 | Mercy | 30/353 |
| 2,651,839 | A | * | 9/1953 | Folland | 30/125 |
| 2,695,450 | A | * | 11/1954 | Platts | 30/342 |
| 2,906,021 | A | * | 9/1959 | Cromoga | 30/293 |
| 3,108,375 | A | * | 10/1963 | Papp | 30/295 |
| 3,605,268 | A | * | 9/1971 | Cassell, Sr. | 30/294 |
| 3,824,688 | A | * | 7/1974 | Goffe | 30/294 |
| 3,918,158 | A | * | 11/1975 | Debski | 30/314 |
| 4,442,570 | A | * | 4/1984 | Lynn | 452/5 |
| 4,593,466 | A | * | 6/1986 | O'Brien | 30/296.1 |
| 4,821,356 | A | | 4/1989 | Finn | 7/134 |
| 4,890,390 | A | | 1/1990 | Begon | 30/346 |
| 4,970,786 | A | | 11/1990 | Harper | 30/123.7 |
| 5,095,623 | A | | 3/1992 | Williams | 30/144 |
| D363,109 | S | | 10/1995 | Hall | D22/118 |
| D366,515 | S | * | 1/1996 | Thompson | D7/469 |
| 5,490,332 | A | * | 2/1996 | Levin | 30/161 |
| 5,528,834 | A | * | 6/1996 | Seber et al. | 30/340 |
| D371,592 | S | * | 7/1996 | Hall et al. | D22/118 |
| 5,581,892 | A | * | 12/1996 | Dean | 30/277.4 |
| 5,581,895 | A | | 12/1996 | Jeffcoat | 30/294 |
| D390,304 | S | | 2/1998 | Thompson | D22/118 |
| D397,016 | S | | 8/1998 | Pohl | D8/99 |
| D422,669 | S | | 4/2000 | Elishewitz | D22/118 |
| 6,052,908 | A | * | 4/2000 | Harman | 30/294 |
| D425,389 | S | | 5/2000 | Elishewitz | D8/98 |
| D441,827 | S | | 5/2001 | Frank | D22/118 |
| 6,308,355 | B1 | | 10/2001 | McMillan et al. | 7/142 |
| D451,571 | S | | 12/2001 | Barker, II | D22/118 |
| D452,546 | S | | 12/2001 | Barker, II | D22/118 |
| 6,401,341 | B1 | * | 6/2002 | Hernandez | 30/136 |
| 6,450,871 | B1 | | 9/2002 | Morrison, Jr. et al. | 452/6 |
| 6,460,255 | B1 | * | 10/2002 | Dassaud | 30/340 |
| 2003/0208910 | A1 | * | 11/2003 | Dudley et al. | 30/314 |

* cited by examiner

CUTTING TOOL WITH SLOPING PROXIMAL PORTION AND ASSOCIATED METHODS

FIELD OF THE INVENTION

The present invention relates to the field of cutting tools, and, more particularly, to the field of cutting tools having curved blades, and associated methods.

BACKGROUND OF THE INVENTION

Cutting tools come in various shapes and sizes, and are used for different purposes. Some different types of cutting tools include knives, swords, and bayonets, for example. Accordingly, cutting tools may include blades that have different shapes and sizes.

U.S. Pat. No. 2,048,322 to Cathey, for example, discloses a paring knife having an elongate handle, and an elongate blade connected to the elongate handle. The elongate blade extends outwardly from the handle in an initial downward curve, followed by an upward curve, and ending in a downswept, tapered tip. In other words, the blade is substantially U-shaped. The blade also includes a sharpened lower edge. The shape and configuration of the blade may, however, limit the use of the knife.

U.S. Design Pat. No. 363,109 to Hall discloses a knife having a curved handle, and an elongate blade connected to the curved handle. The elongate blade includes hook-shaped portions along the upper and lower edges adjacent the handle, and upper and lower sharpened edges opposite the handle and, ends in an upswept, tapered tip. The lower hook portions of the blade may interfere with uses of the sharpened lower edge for cutting or slicing applications, for example.

U.S. Pat. No. 5,095,623 to Williams discloses a firefighting tool including an elongate handle, and an elongate blade connected to the elongate handle. The elongate blade includes a substantially linear proximal portion extending longitudinally outwardly from an end of the handle, a substantially linear medial portion extending outwardly along an angle from an end of the proximal portion, and a substantially linear distal portion extending outwardly along an angle from an end of the medial portion. The blade also includes a sharpened upper edge. A lower edge of the proximal portion of the blade is sharpened, and the lower edge of the medial and distal portions are saw-shaped. This blade may be disadvantageous because the saw-shaped portions of the blade may interfere with use of the sharpened lower edge.

SUMMARY OF THE INVENTION

In view of the foregoing background, it is therefore an object of the present invention to provide a more versatile cutting tool.

This, and other objects, features, and advantages of the present invention are provided by a cutting tool that may comprise an elongate handle to be grasped by a user, and an elongate blade connected to the elongate handle. The elongate blade may comprise a downwardly sloping proximal portion extending outwardly from an end of the handle, and a linear distal portion extending substantially parallel to and downwardly offset from an axis defined by the elongate handle and ending in a tapered tip.

The downwardly sloping proximal portion may have a sharpened lower edge and the linear offset distal portion may have a sharpened lower edge. The linear offset distal portion may also have a sharpened upper edge. The sharpened upper and lower edges advantageously allow the cutting tool to be used for many different applications. The tapered tip of the linear offset distal portion may curve upwardly to define an upswept tip at an angle of about 5 to 15 degrees.

The downwardly sloping distal portion may break downwardly at an angle of about 30 to 50 degrees from the axis of the handle and may have a substantially uniform predetermined width. The linear offset distal portion may also have the predetermined width upstream of the tapered tip.

The cutting tool may also comprise a guard connected between the handle and the blade. The guard may comprise a thumb guard portion extending upwardly and a finger guard portion extending downwardly. The guard advantageously provides a buffer between the users hand and the elongate blade. The downwardly sloping proximal portion and the linear offset distal portion may have about equal lengths. In some embodiments, the blade may have a length of less than about twelve inches so that the cutting tool is a knife. In other embodiments, the blade may have a length of greater than about twelve inches so that the cutting tool is a sword.

A method aspect of the present invention is for making the cutting tool. The method may comprise connecting an elongate blade, as described above, to an elongate handle to be grasped by a user.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

Figure 1:
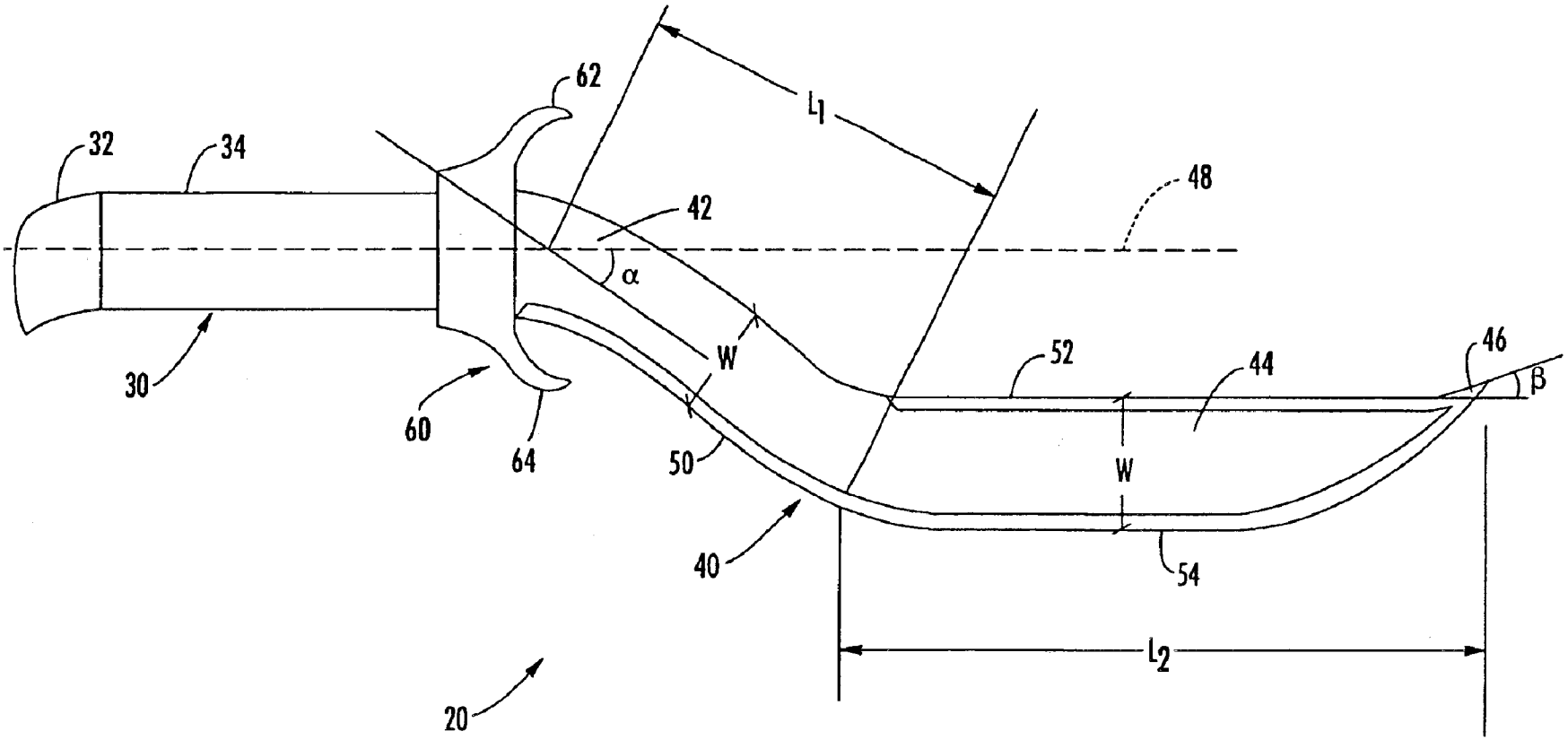
FIG. 1 is a side elevation view of the cutting tool according to the present invention.

Referring initially to FIG. 1, a cutting tool 20 according to the present invention is now described. The cutting tool 20 illustratively includes an elongate handle 30 to be grasped by a user, and an elongate blade 40 connected to the elongate handle. The elongate blade 40 illustratively comprises a downwardly sloping proximal portion 42 extending longitudinally outwardly from an end of the handle 30, and a linear distal portion 44 extending substantially parallel to and downwardly offset from an axis 48 defined by the elongate handle, and ending in a tapered tip 46.

The downwardly sloping proximal portion 42 illustratively has a sharpened lower edge 50, and the curved distal portion 44 illustratively has a sharpened upper edge 52 and a sharpened lower edge 54. The sharpened lower edges 50, 54 of the downwardly sloping proximal portion 42 and the linear offset distal portion 44 are advantageous when using the cutting tool 20 for chopping, or slicing, for example, or other common uses as will be understood by those skilled in the art. The sharpened upper edge 52 of the linear offset distal portion 44 is also advantageous when using the cutting tool 20 for slicing in an upward direction, for example, or other common uses of as will also be understood by those skilled in the art.

The downwardly sloping proximal portion 42 of the elongate blade 40 illustratively has a uniform width, illustrated in FIG. 1 as W. The width W may be within the range of about 1 to 3 inches, for example. The linear offset distal portion 44 of the blade 40 also illustratively has the width W upstream of the tapered tip. The elongate blade 40 may comprise metal, for example, or another material having high strength properties capable of withstanding an impact, and repetitive use, for example, as understood by those skilled in the art.

The downwardly sloping proximal portion 42 of the elongate blade 40 has a length $L_1$, and the linear offset distal portion 44 of the blade has a length $L_2$. The length $L_1$ of the downwardly sloping proximal portion 42 and the predetermined length $L_2$ of the linear offset distal portion 44 are illustratively about equal. For example, the length $L_1$ may be about 3 inches and the length $L_2$ may be about 4 inches, although other dimensions are also contemplated by the present invention. In some embodiments, an overall length of the elongate blade 40 may be less than about 12 inches so that the cutting tool 20 is a knife. In other embodiments, the overall length of the elongate blade 40 may be greater than about 12 inches so that the cutting tool 20 is a sword.

The cutting tool 20 also illustratively comprises a guard 60 connected between the elongate handle 30 and the elongate blade 40. The guard 60 illustratively comprises a thumb guard portion 62 extending upwardly, and a finger guard portion 64 extending downwardly. More specifically, the thumb guard portion 62 is curved and extends upwardly and outwardly over an upper edge of the downwardly sloping proximal portion 42 of the blade 40. The finger guard portion 64 is also curved and extends downwardly and outwardly over the sharpened lower edge 54 of the downwardly sloping proximal portion 42 of the blade 40. The guard 60 advantageously provides a buffer between the users hand and the elongate blade 40 to protect the hand of the user from contact with the blade.

The elongate handle 30 illustratively includes a butt end 32 opposite the guard 60. The butt end 32 may be curved downwardly to facilitate gripping by the user. The butt end 32 may be weighted to balance the cutting tool 20. For example, the weighted butt end 32 may have a weight substantially similar to the weight of the blade 40 so that the cutting tool 20 is balanced when grasped in the hand of a user. The elongate handle 30 may further include a non-slip grip surface. The non-slip grip surface may be provided by a dimpled rubber coating, for example, or another similar material as will be understood by those skilled in the art.

The downwardly sloping proximal portion 42 of the blade 40 illustratively breaks downwardly at an angle $\alpha$ from the axis 48 of the elongate handle 30. More particularly, the angle $\alpha$ may be between about 30 and 50 degrees from the axis 48 of the elongate handle 30. The downward angle $\alpha$ of the proximal portion 42, along with the sharpened lower edge 54, is advantageous when using the cutting tool 20 to cut or slice, for example, in a downward direction.

The tapered tip 46 of the linear offset distal portion 44 of the blade 40 illustratively curves upwardly to define an upswept tip. More particularly, the upswept tip is illustratively upswept at an angle $\beta$ from the linear offset distal portion 44 of the blade 40. The angle $\beta$ may be about 5 to 15 degrees from an adjacent portion of the linear offset distal portion 44 of the blade 40. The upswept tip 46, along with the sharpened upper edge 52 of the linear offset distal portion 44, is advantageous when using the cutting tool 20 piercing, for example.

Figure 2:
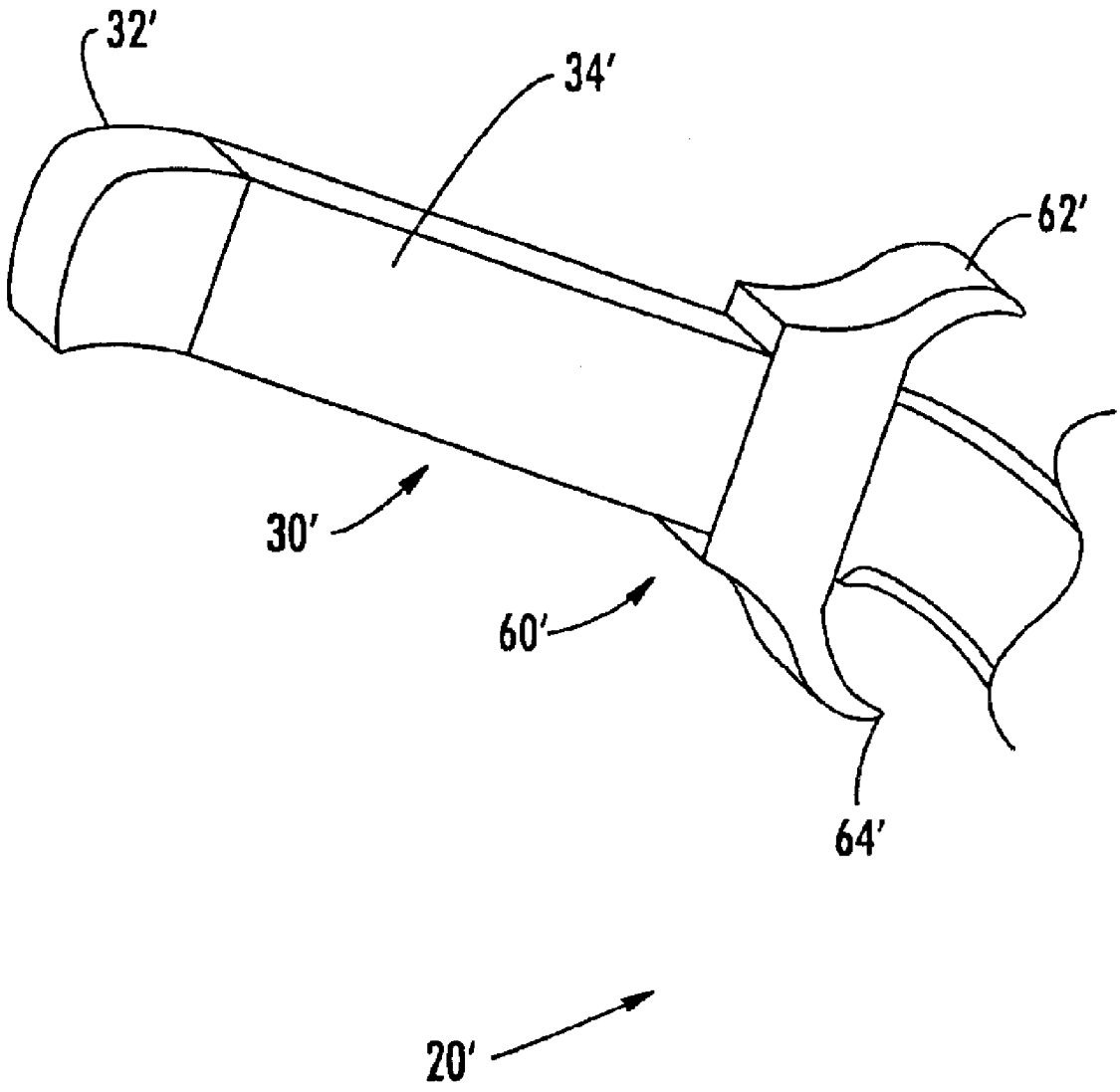
FIG. 2 is a perspective view of an alternate embodiment of the handle of the cutting tool according to the present invention.

Turning now to FIG. 2, an alternate embodiment of the elongate handle 30' of the cutting tool 20' is described. The elongate handle 30' includes a grip 34'. The grip 34' may include indentations (not shown) for receiving the fingers and thumb of the hand of the user. The indentations advantageously facilitate gripping of the elongate handle 30' by the user. The butt end 32' of the elongate handle 30' may be curved downwardly so that the user may better secure the grip 34'. The other elements of the alternate embodiment of the elongate handle 30' of the cutting tool 20' are similar to those of the first embodiment, are identified using prime notation and require no further discussion herein.

A method aspect of the present invention is for making a cutting tool 20. The method may comprise connecting an elongate blade 40, as described above, to an elongate handle 30 to be grasped by a user. The method may further comprise connecting a guard 60, as described above, between the elongate handle 30 and the elongate blade 40.

Other aspects of the cutting tool 20 are described in co-pending U.S. patent application Ser. No. 10/295,786, entitled "Cutting Tool With Curved Distal Portion And Associated Methods", having Attorney Docket No. 113.2168, filed concurrently herewith, the entire contents of which are incorporated herein by reference. Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that other modifications and embodiments are intended to be included within the scope of the appended claims.

That which is claimed is:

1. A cutting tool comprising:

an elongate handle to be grasped by a user; and an elongate blade connected to said elongate handle and comprising a first portion extending outwardly from an end of said handle and having a substantially triangular shape, a downwardly sloping proximal portion extending outwardly from an end of said first portion, and a linear distal portion extending substantially parallel to and downwardly offset from an axis defined by said elongate handle and ending in a tapered tip;

said downwardly sloping proximal portion having a sharpened lower edge extending substantially the length of said downwardly sloping proximal portion;

said linear offset distal portion having a sharpened lower edge.

2. A cutting tool according to claim 1 wherein said linear offset distal portion has a sharpened upper edge.

3. A cutting tool according to claim 1 wherein the tapered tip of said linear offset distal portion curves upwardly to define an upswept tip.

4. A cutting tool according to claim 3 wherein the upswept tip is upswept at an angle of about 5 to 15 degrees.

5. A cutting tool according to claim 1 wherein said downwardly sloping distal portion breaks downwardly at an angle of about 30 to 50 degrees from the axis of said handle.

6. A cutting tool according to claim 1 wherein said downwardly sloping proximal portion has a substantially uniform predetermined width.

7. A cutting tool according to claim 6 wherein said linear offset distal portion also has the predetermined width upstream of said tapered tip.

8. A cutting tool according to claim 1 further comprising a guard connected between said handle and said blade.

9. A cutting tool according to claim 8 wherein said guard comprises a thumb guard portion extending upwardly and a finger guard portion extending downwardly.

10. A cutting tool according to claim 1 wherein said downwardly sloping proximal portion and said linear offset distal portion have about equal lengths.

11. A cutting tool according to claim 1 wherein said blade has a length of less than about twelve inches so that the cutting tool is a knife.

12. A cutting tool according to claim 1 wherein said blade has a length of great than about twelve inches so that the cutting tool is a sword.

13. A cutting tool comprising:

an elongate handle to be grasped by a user;

a guard connected to said elongate handle; and an elongate blade connected to said guard and comprising a first portion extending outwardly from an end of said guard and having a substantially triangular shape, a downwardly sloping proximal portion extending outwardly from an end of said first portion, and a linear offset distal portion extending substantially parallel to and downwardly offset from an axis defined by said elongate handle and ending in an upswept tapered tip;

said downwardly sloping proximal portion and said linear offset distal portion have about equal lengths.

14. A cutting tool according to claim 13 wherein the upswept tip is upswept at an angle of about 5 to 15 degrees.

15. A cutting tool according to claim 13 wherein said downwardly sloping proximal portion has a sharpened lower edge extending substantially the length of said downwardly sloping proximal portion.

16. A cutting tool according to claim 13 wherein said linear offset distal portion has a sharpened lower edge.

17. A cutting tool according to claim 13 wherein said linear offset distal portion has a sharpened upper edge.

18. A cutting tool according to claim 13 wherein said downwardly sloping distal portion breaks downwardly at an angle of about 30 to 50 degrees from the axis of said handle.

19. A cutting tool according to claim 13 wherein said downwardly sloping proximal portion has a substantially uniform predetermined width.

20. A cutting tool according to claim 19 wherein said linear offset distal portion has a substantially uniform predetermined width upstream of said tapered tip.

21. A cutting tool according to claim 13 wherein said guard comprises a thumb guard portion extending upwardly and a finger guard portion extending downwardly.

22. A cutting tool according to claim 13 wherein said blade has a length of less than about twelve inches so that the cutting tool is a knife.

23. A cutting tool according to claim 13 wherein said blade has a length of greater than about twelve inches so that the cutting tool is a sword.

24. A method of making a cutting tool comprising:

connecting an elongate blade to an elongate handle to be grasped by a user, the elongate blade comprising a first portion extending outwardly from an end of the handle and having a substantially triangular shape, a downwardly sloping proximal portion extending outwardly form an end of the first portion, and a linear offset distal portion extending substantially parallel to and downwardly offset from an axis defined by the elongate handle and ending in a tapered tip;

the downwardly sloping proximal portion having a sharpened lower edge extending substantially the length of the downwardly sloping proximal portion;

the linear offset distal portion having a sharpened lower edge.

25. A method according to claim 24 wherein the tapered tip of the linear offset distal portion curves upwardly to define an upswept tip.

26. A method according to claim 25 wherein the upswept tip is upswept at an angle of about 5 to 15 degrees.

27. A method according to claim 24 wherein the downwardly sloping distal portion breaks downwardly at an angle of about 30 to 50 degrees from the axis of the handle.

28. A method according to claim 24 further comprising connecting a guard between the handle and the blade.

* * * * *